US008684630B2

(12) United States Patent
Mahmoud

(10) Patent No.: US 8,684,630 B2
(45) Date of Patent: Apr. 1, 2014

(54) UNDERWATER REINFORCED CONCRETE SILO FOR OIL DRILLING AND PRODUCTION APPLICATIONS

(76) Inventor: Mostafa H. Mahmoud, Bonita Springs, FL (US)

( * ) Notice: Subject to any disclaimer, the term of this patent is extended or adjusted under 35 U.S.C. 154(b) by 93 days.

(21) Appl. No.: 13/184,794

(22) Filed: Jul. 18, 2011

(65) Prior Publication Data

US 2012/0020742 A1 Jan. 26, 2012

Related U.S. Application Data

(60) Provisional application No. 61/366,544, filed on Jul. 22, 2010.

(51) Int. Cl.
*E02B 17/00* (2006.01)

(52) U.S. Cl.
USPC ..... 405/228; 405/224; 405/208; 405/205

(58) Field of Classification Search
USPC ..... 405/203, 204, 205, 208, 209, 210, 227, 405/228
See application file for complete search history.

(56) References Cited

U.S. PATENT DOCUMENTS 3,339,367 A * 9/1967 Lacy, Jr. ..... 405/210
3,488,967 A * 1/1970 Toossi ..... 405/210
3,624,702 A * 11/1971 Meheen ..... 405/227
3,675,431 A * 7/1972 Jackson ..... 405/210
3,708,987 A * 1/1973 Roulet et al. ..... 405/210
3,738,113 A * 6/1973 Madary et al. ..... 405/210
3,751,930 A * 8/1973 Mott et al. ..... 405/196
3,766,583 A * 10/1973 Phelps ..... 405/203
3,791,152 A * 2/1974 Davis et al. ..... 405/210
3,824,795 A * 7/1974 Mo ..... 405/207
3,828,565 A * 8/1974 McCabe ..... 62/53.1
3,870,010 A * 3/1975 Wright ..... 114/230.13
3,999,395 A * 12/1976 Broms et al. ..... 405/227
4,126,010 A * 11/1978 Michel et al. ..... 405/202
4,200,411 A * 4/1980 Brown et al. ..... 405/210
4,241,685 A * 12/1980 Mougin ..... 405/210
4,304,506 A * 12/1981 Olsen ..... 405/224
4,416,565 A * 11/1983 Ostlund ..... 405/210
4,422,804 A * 12/1983 Gerwick et al. ..... 405/210
4,470,725 A * 9/1984 Kure et al. ..... 405/212
4,484,841 A * 11/1984 Einstabland ..... 405/212
4,504,172 A * 3/1985 Clinton et al. ..... 405/217
4,793,739 A * 12/1988 Hasle et al. ..... 405/227
4,815,894 A * 3/1989 Copson ..... 405/210
4,904,118 A * 2/1990 Thiemann, III ..... 405/195.1
5,044,830 A * 9/1991 Barbaras et al. ..... 405/210
5,186,581 A * 2/1993 Ngoc et al. ..... 405/210
6,244,785 B1 * 6/2001 Richter et al. ..... 405/195.1
6,575,665 B2 * 6/2003 Richter et al. ..... 405/195.1

* cited by examiner

*Primary Examiner* — Frederick L Lagman
(74) *Attorney, Agent, or Firm* — Mueller Law, LLC; Jerry K. Mueller, Jr.

(57) ABSTRACT

Concrete silo for offshore drilling and production operations includes a reinforced concrete foundation secured at the seabed by steel piles and steel anchors embedded into the seabed. An exterior vertical reinforced concrete wall is supported by the foundation. An interior vertical reinforced concrete wall is supported by the foundation and houses a central cell. A series of radial shear walls extend between the exterior concrete wall and the interior concrete wall to form a series of perimeter cells. A roof and series of horizontally extending service platforms are supported off of the outer concrete wall and the interior concrete wall. A series of vertical well casings extend through the concrete foundation and down into the seabed for drilling operations.

18 Claims, 5 Drawing Sheets

UNDERWATER REINFORCED CONCRETE SILO FOR OIL DRILLING AND PRODUCTION APPLICATIONS

CROSS-REFERENCE TO RELATED APPLICATIONS

This application claims benefit of provisional application Ser. No. 61/366,544 filed on Jul. 22, 2010, the disclosure of which is expressly incorporated herein by reference.

STATEMENT REGARDING FEDERALLY SPONSORED RESEARCH

Not applicable.

BACKGROUND

This disclosure relates to offshore drilling and production operations in general and more specifically to a multi-cell reinforced concrete circular silo wherein ocean/lake drilling and production takes place.

Concrete offshore structures are mostly used in the petroleum industry as drilling, extraction, or storage units for crude oil or natural gas. Such large structures house machinery and equipment needed to drill and/or extract oil and gas. But concrete structures are not only limited to applications within the oil and gas industry. Several conceptual studies have shown recently, that concrete support structures for offshore wind turbines are very competitive compared to common steel structures, especially for larger water depths.

Depending on the circumstances, platforms may be attached to the ocean floor, consist of an artificial island, or be floating. Generally, offshore concrete structures are classified into fixed and floating structures. Fixed structures are mostly built as concrete gravity based structures (CGS, also termed as caisson type), where the loads bear down directly on the uppermost layers as soil pressure. The caisson provides buoyancy during construction and towing and acts also as a foundation structure in the operation phase. Furthermore, the caisson could be used as storage volume for oil or other liquids.

Floating units will be held in position by anchored wires or chains in a spread mooring pattern. Because of the low stiffness in those systems, the natural frequency is low and the structure can move in all six degrees of freedom. Floating units serve as productions units, storage and offloading units (FSO) or, for crude oil or as terminals for liquefied natural gas (LNG). A more recent development is concrete sub-sea structures. Concrete offshore structures show an excellent performance. They are highly durable, constructed of almost maintenance-free material, suitable for harsh and/or arctic environment (like ice and seismic regions), can carry heavy topsides, often offer storage capacities, are suitable for soft grounds and are very economical for water depths larger than 150 m. Most gravity-type platforms need no additional fixing because of their large foundation dimensions and extremely high weight.

The Deepwater Horizon oil spill (also referred to as the BP oil spill, the Gulf of Mexico oil spill, the BP oil disaster, or the Macondo blowout) is an oil spill in the Gulf of Mexico, which flowed for three months in 2010. It is the largest accidental marine oil spill in the history of the petroleum industry. The Deepwater Horizon rig is a fifth-generation, dynamically positioned, semi-submersible mobile offshore drilling unit capable in water up to 10,000 ft deep. The spill stemmed from the Apr. 20, 2010 blowout of the Mocando well resulting in loss of main power, explosions and uncontrollable fire onboard the Deepwater Horison. The disabled drill rig began to drift away from the wellhead and the drill pipe that was stretched between the rig and the well head separated at the blowout preventer increasing the flow of oil into the gulf. On Jul. 15, 2010, the leak was stopped by capping the gushing wellhead after it had released about 4.9 million barrels (780,000 $m^3$) of crude oil. An estimated 53,000 barrels per day (8,400 $m^3$/d) escaped from the well just before it was capped. The spill caused extensive damage to marine and wildlife habitats and to the Gulfs fishing and tourism industries.

Thus, while technology ever advances in permitting access to offshore oil deposits, drilling in such marine environments is not without substantial risks. There certainly is a need for oil drilling and production technology that minimizes the risks of incidents similar to the Macondo incident and exhibits much improved oil spill containment ability. It is to such need that the present invention is addressed, including a structure that can completely contain a 780,000 $m^3$ oil leak.

SUMMARY OF THE DISCLOSURE

Disclosed is a multi-cell reinforced concrete circular in horizontal cross section silo for deep underwater oil and gas well drilling and production applications in waters of, say, ±5,000 feet deep. Drilling for oil takes place from the bottom of the silo (top of foundation) using modified landside equipment. The spillage risks associated with the disclosed silo are comparable to the risks associated with land based drilling systems, which are significantly lower than the risks associated with current systems capable of drilling for oil at such water depths.

Broadly, disclosed is a reinforced concrete circular silo with foundation slab seated into the seabed where ballast and buoyancy result in an acceptable bearing pressure on seabed material and where overturning moments and shear forces resulting from wind and water actions on the silo are resisted by passive soil resistance and a system of steel piles and steel anchors deriving support from competent seabed base material.

The silo will be constructed on location starting with the foundations followed by the walls, the service platforms, and the balance of construction. This disclosure does not envision or require the use of a dry dock.

BRIEF DESCRIPTION OF THE DRAWINGS

For a fuller understanding of the nature and advantages of the present apparatus and method, reference should be had to the following detailed description taken in connection with the accompanying drawings, in which.

Figure 1:
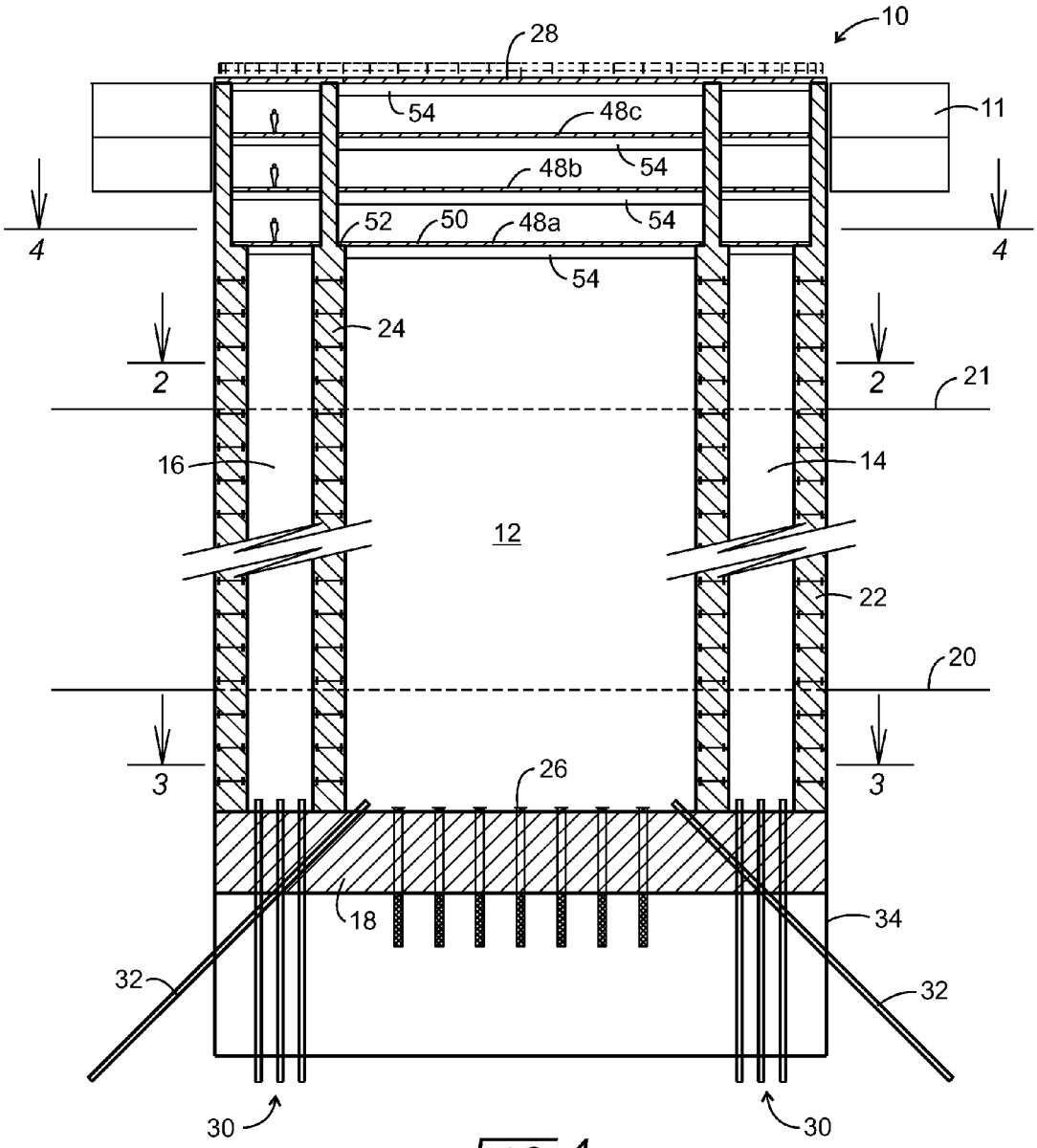
FIG. 1 shows an overall cross section elevation of the silo.

These drawings will be described in further detail below.

DETAILED DESCRIPTION OF THE SILO

Concrete silo for offshore drilling and production operations includes a reinforced concrete foundation embedded into sea bed and secured by steel piles and steel anchors embedded into the seabed. An exterior vertical reinforced concrete wall is supported by the foundation. An interior vertical reinforced concrete wall is supported by the foundation and houses a central cell. A series of radial shear walls extend between the exterior concrete wall and the interior concrete wall to form a series of perimeter cells. The silo walls support a roof and a series of horizontally extending service platforms. A series of vertical well casings extend through the concrete foundation and down into the seabed.

The disclosed silo, then, consists of foundations, walls, roof, and, for example, three (3) service platforms with office and personnel space cantilevered off the exterior face of the silo. A brief description of each component follows. The number of components and their dimensions are illustrative in this disclosure and are not a limitation thereon. The skilled artisan will be able to design, engineer, fabricate, install, and use the disclosed silo at various ocean/lake depths at different geographical locations under varying circumstances based on the disclosure set forth herein.

The silo foundation consists of a reinforced concrete slab 150 ft in diameter×20 ft thick. A structural steel skirt extending 40 feet below the bottom of the foundation is provided for foundation buoyancy during early stages of construction and for proper seating of the foundation into seabed material. Buoyancy will be achieved and adjusted by pumping compressed air into the body of water enclosed by the skirt.

The foundation incorporates forty five (45) 2-ft diameter× 33 ft long steel pipe inserts to provide means for accurately locating and installing the casings used in drilling the oil wells through the foundation slab after the completion of silo construction. The foundation also incorporates one hundred seventy six (176) structural steel inserts in the shape of a steel pile cutout to provide means for accurately locating and installing the piles. The foundation also includes steel pipe sleeves for accurately locating and installing steel anchors, if required. The inserts and the sleeves eliminate the potential for interference with the reinforcing steel and other items and ensure accurate placement of each item. The concrete for the silo foundation will be placed in one 13,090 cubic yard continuous pour.

The silo walls consist of an exterior wall having 134 ft inside diameter and 8 ft in thickness, and an interior wall having 86 ft inside diameter and 8 ft thickness. Eight (8) radial shear walls located at 45 degrees center-on-center ("c/c") connect the exterior and the interior walls. The total height of silo wall is ±5,080 ft for water having a depth of nominally 5,000 ft. The silo wall will be constructed in 8 ft high lifts with the concrete of each lift placed in one 1,910 cubic yard continuous pour.

To ensure that water will not enter the interior of the silo through the construction joints between pours, a structural steel water-stop placed in the top of each pour and projecting 8 inches into the pour above will be placed at each construction joint including the joint between the top of the foundation and the wall, and the joint between the top of the wall and the roof. An appropriate bonding agent will be applied to the surface of the joint and the water stop plate, if required.

After the silo wall construction is complete and the silo is seated on or into appropriate seabed material, the steel piles and the steel anchors will be installed utilizing landside equipment. The silo roof and any remaining work on the service platforms will be completed next and the personnel and office space will be completed last. The structural/mechanical/electrical work for oil well drilling and production takes place at that point.

Operational Considerations

A silo, 10, consists of one central cell, 12, and eight perimeter cells, such as perimeter cells, 14 and 16, constructed on top of a circular foundation, 18, seated on or into adequate seabed material, 20, and extending above the water surface, 21, as schematically depicted in FIGS. 1 through 9. Silo 10 is defined by an annular exterior silo wall, 22, an annular interior silo wall, 24, and eight (8) radial walls, 25*a*-25*h*. After completion of construction, silo 10 will initially house well drilling operations. After well drilling is completed, oil production and storage also can begin within the confines of silo 10.

Figure 3:
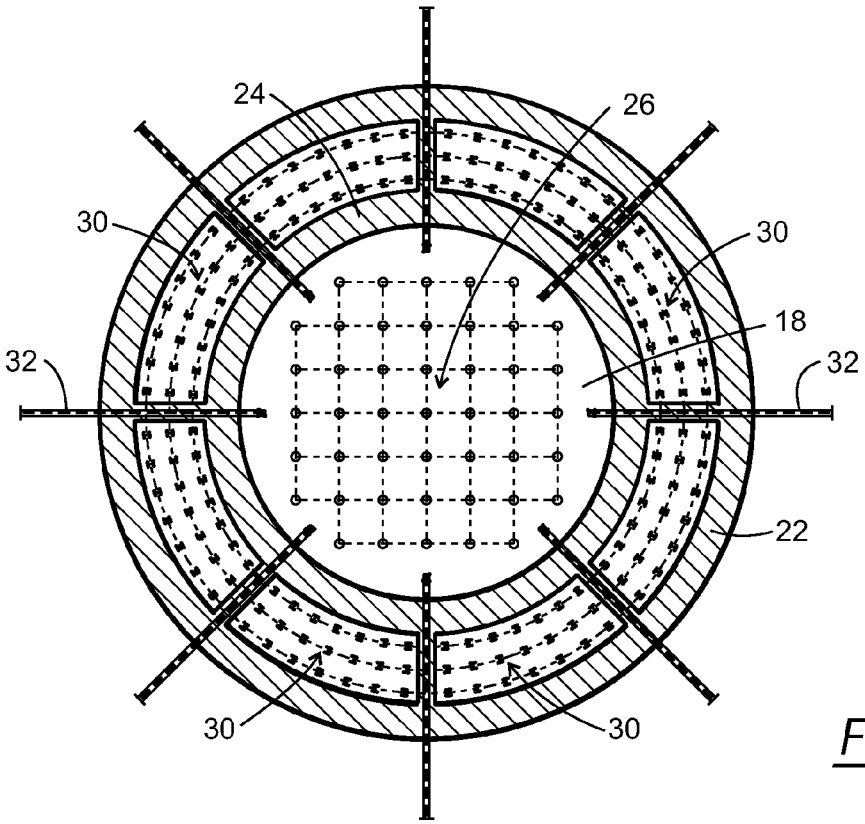
FIG. 3 is a cross-sectional view taken along line 3-3 of FIG. 1.

In the present illustrated configuration, all the wells are located within central cell enclosure 12, such as shown in FIG. 3. With a slightly different arrangement, wells could be located in one or more perimeter cells, such as perimeter cells 14 and 16. Such arrangement would make it possible to start oil production incrementally. In other words, oil production could start in perimeter cells while well drilling continues in the central cell 12 or vice versa.

The disclosed configuration is based on operating in a water depth of ±5,000 ft. The disclosed configuration can be scaled up to permit operation at a water depth of ±10,000 ft. The disclosed configuration can be scaled down to permit a cost effective structure for operating in a water depth much less than 5,000 ft. In the present configuration, central cell 12 has forty-five (45) well casings, such as is illustrated by well casing pipe inserts 26, embedded in silo foundation 18. Center to center spacing of casings is ±9'-10". The diameter of silo 10 can be scaled up or down to accommodate a different number of well casings.

Riser lines from the wells could be supported off the interior surface of annular wall 24 of central cell 12 or could be re-routed through the perimeter cells. Oil and gas processing equipment could be located on structural steel floor(s) at an appropriate distance above silo foundation 18, on a silo roof, 28, or on one the service platforms, 48*a*-48*c*. The disclosed configuration admits of the possibility of locating an oil refining system within central cell 12.

The perimeter cells will be utilized for personnel access to the work areas, transport of equipment in and out of the work areas, storage of oil and other fluids and solids associated with drilling and production, ballast required to ensure proper seating of silo foundation into seabed floor, routing of riser pipes to oil storage or to surface facilities, HVAC, and utility and power lines.

The following items will be most likely located on silo roof, 28:

Cranes, hoists, etc., for transporting equipment in and out of silo 10.

Helicopter pad.

The following items will be most likely located in the personnel and office space, 11, supported off (cantilevered) the exterior surface of silo 10, as schematically shown in FIG. 1:

Personnel support and services.

Control rooms.

Machine shop.

Once the construction of silo 10 is completed, drilling of wells will be performed from the bottom of the silo utilizing modified land-based drilling systems. Drilling multiple wells simultaneously should be considered, as it may result in significant savings.

Locating riser and utility pipes within the perimeter cells makes them accessible for inspection and monitoring all the time. In a worst-case scenario, if a riser line ruptures, the resulting fire and the released fluids will be contained within the confine of the cell where the failure occurred. The affected cell could be flooded easily with seawater and the fire put out. This disclosure envisions constructing fire floors at appropriate locations to help control fire spread and to facilitate flooding with water. Adequate HVAC creates a work environment at the base of the silo very comparable to, or better than, the work environment of land-based operations.

Design and Construction

The disclosed silo is the first reinforced concrete offshore structure specifically designed to be constructed and operated in deep water at depths of ±5,000 ft. With appropriate scaling up, this design can be extended to water depths of ±10,000 ft.

This silo is the first reinforced concrete gravity offshore structure designed to be constructed and operated in water depth of 5,000 ft (±) with the weight of the silo and its contents resisted by a combination of buoyancy and foundation bearing on and into the seabed, and lateral loads and overturning moments due to water and wind actions resisted by passive soil resistance, steel piles, and steel anchors.

Lateral loads due to wind, water currents, and wave action will subject the silo to significant horizontal shears and overturning moments. Steel piles, 30, and steel anchors 32, as schematically depicted in FIGS. 1 and 3, will resist silo base shear and overturning moments. Steel piles 30 and steel anchors 32 are illustrative thereof. The length and the allowable load capacity of the piles will be determined by a geotechnical investigation of the seabed material. Silo 10 will be embedded an appropriate distance into competent base material, seabed 20, to ensure adequate passive soil resistance. Steel piles 30 and batter steel piles or anchors 32 minimize the risks of total and differential settlement commonly encountered in gravity concrete offshore structures seated on or in seabed material and the damage such settlement does to the piping systems in the facility.

Silo 10 is designed and constructed to resist ±312,500 pounds per square ft of hydrostatic water pressure near the bottom of silo 10. Silo foundation 18 consists of a reinforced concrete slab 150 ft in diameter×20 ft thick. A structural steel skirt, 34, extending 40 feet below the bottom of foundation 18 is provided for foundation buoyancy during initial construction and for proper seating of the foundation into seabed material 20. Buoyancy will be adjusted as needed by pumping compressed air in the body of water enclosed by skirt 34.

Silo foundation 18 will be constructed over water utilizing a floating work platform, 36, as schematically depicted in FIGS. 5, 6, 7, and 8. Floating work platform 36 will be fabricated in sections and transported by barges to the construction site. Floating work platform 36 will be field assembled by bolting or other means. The position of floating work platform 36 relative to silo foundation 18 and wall 22 will be controlled by buoyancy. Silo 10 is designed and constructed with foundations floating in water. No dry dock construction is required.

Silo 10 is unique in that it is a reinforced concrete offshore structure seated on or in seabed material where deep foundations (steel piles and steel anchors) are installed after the silo foundations are seated on or in seabed material (through sleeves in the foundation slab).

Figure 6:
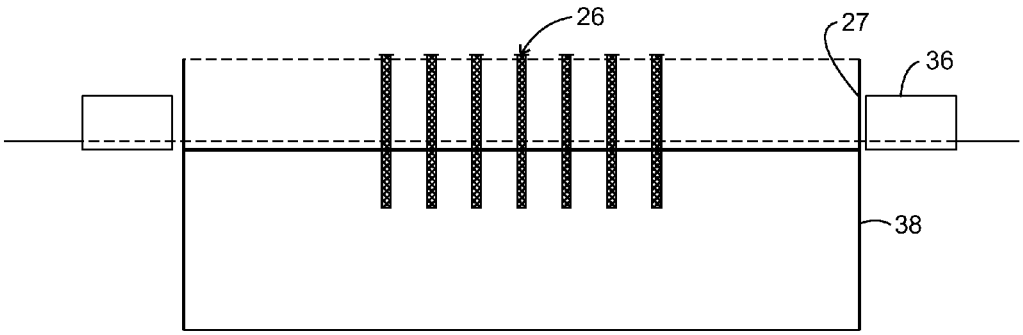
FIG. 6 shows a schematic section elevation of the floating work platform and the silo foundation form prior to placement of concrete.
Figure 7:
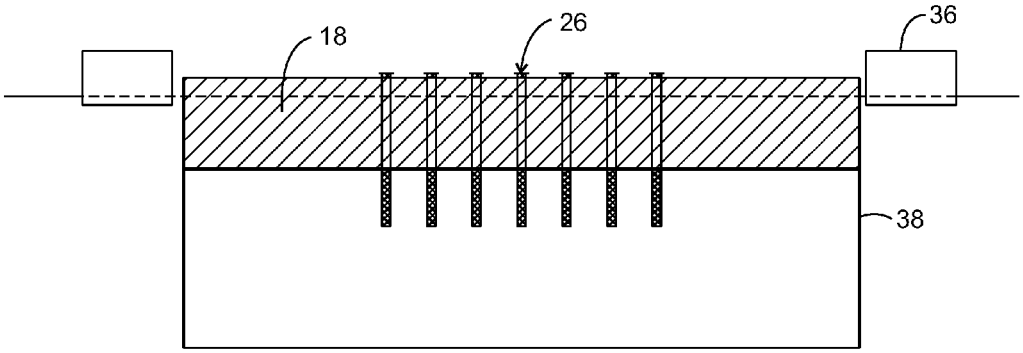
FIG. 7 shows a schematic section elevation of the floating work platform and the silo foundation after placement of concrete.

The foundation forms, such as form 38, will be shop fabricated from structural steel plate, as schematically depicted in FIGS. 6 and 7. Foundation inserts will be shop welded to the forms and all reinforcing steel will be shop placed in the forms. The assembled foundation form will be loaded on a barge and transported to the site for placement of concrete. This disclosure envisions placing the foundation concrete in one 13,090 cubic yard continuous pour. A floating work platform, 36, sits atop water surface 21 to aid in the concrete pour (see also FIG. 8).

Silo foundation 18 incorporates forty-five (45) 2 ft diameter×33 ft long steel pipe inserts (pipe insert 26), as schematically depicted in FIGS. 1, 3, 5, 6, 7 and 8. The inserts will be utilized as a guide for installing the casing used in drilling the oil wells. By pre-positioning the pipe inserts in the foundation before pouring concrete, significant cost savings are achieved and the accuracy of pipe placement is assured. Furthermore, interference with foundation reinforcing and the steel piles is avoided, yet another cost savings. The pipe inserts will be filled with an appropriate type of concrete and provided with cover steel plates to prevent water from flowing through the inserts into silo central cell 12 during construction.

Silo foundation 18 incorporates one hundred seventy six (176) steel piles (see illustrative piles 30) for transmitting foundation loads due wind and water actions to the seabed material. These piles will be installed after silo 10 is positioned at its final location and properly seated seabed material 20. To accurately position and install the piles in place, structural steel sleeves are incorporated in the shape of a steel pile cutout to be positioned in the silo foundation forms before placing the concrete. The sleeves provide the means of accurately locating and installing the piles 30 through the silo foundation 18 and will eliminate the potential for interference with the reinforcing steel and the batter steel piles or anchors 32. Pile driving will be performed using land-based systems. Structural steel framing installed at an appropriate level above the foundation will be configured as required to facilitate pile driving. The merit of simultaneously driving multiple piles is to be considered.

The concrete for the silo walls, such as walls 22 and 24, will be placed (poured) in 8-foot high lifts with the objective of placing three (3) lifts per day. The 8-foot high forms, 27*a*-27*h*, for each lift, schematically illustrated in FIGS. 2 and 9 (heavy lines in FIG. 2), are fabricated and assembled in the shop and all reinforcing steel and inserts are placed in the form. These forms are stay-in-place forms. Each form assembly 27 is loaded on a barge and transported to the construction site. The lift assembly is lifted by crane and secured in position and the concrete placed. To ensure that water does not penetrate to the interior of the silo through the construction joints between the lifts or through the construction joint between the foundation and the wall, a steel plate water-stop capable of resisting the maximum anticipated water pressure would be fabricated and installed at all wall joints (illustrated by a water stop, 42, in FIG. 8).

Figure 8:
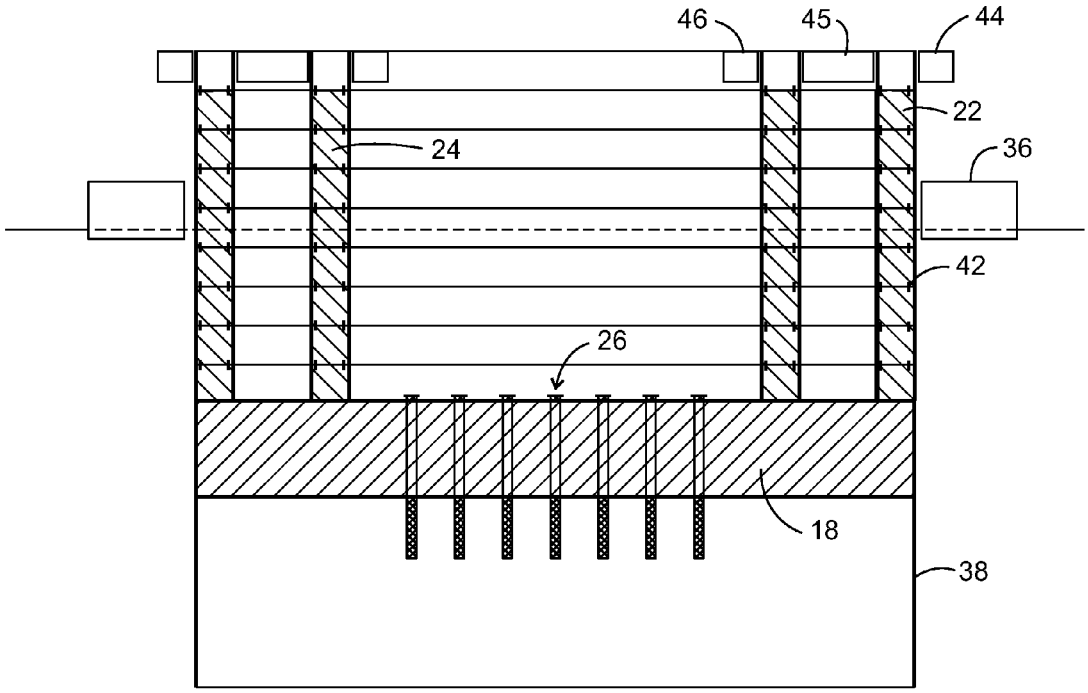
FIG. 8 shows a cross section elevation during construction of the silo showing the working floating platforms and steel forms for the interior and exterior annular walls.
Figure 9:
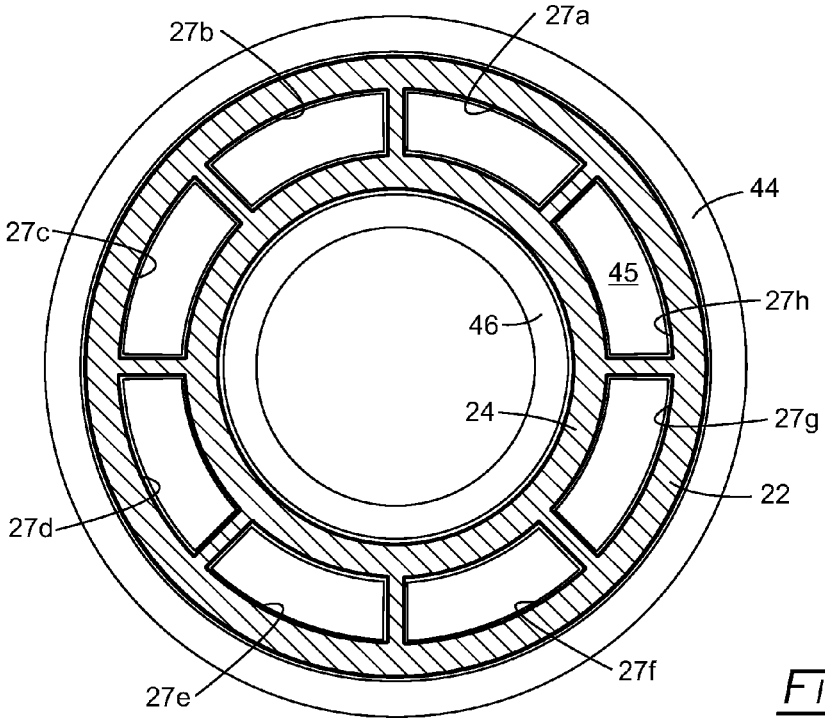
FIG. 9 is a plan view of FIG. 8.

To ensure safe access to the construction work area, motorized climbing work platforms, illustrated by climbing work platforms 44, 45, and 46, are provided for central cell 12, the eight (8) perimeter cells, and on the exterior surface of silo 10 as schematically depicted in FIG. 8.

Figure 4:
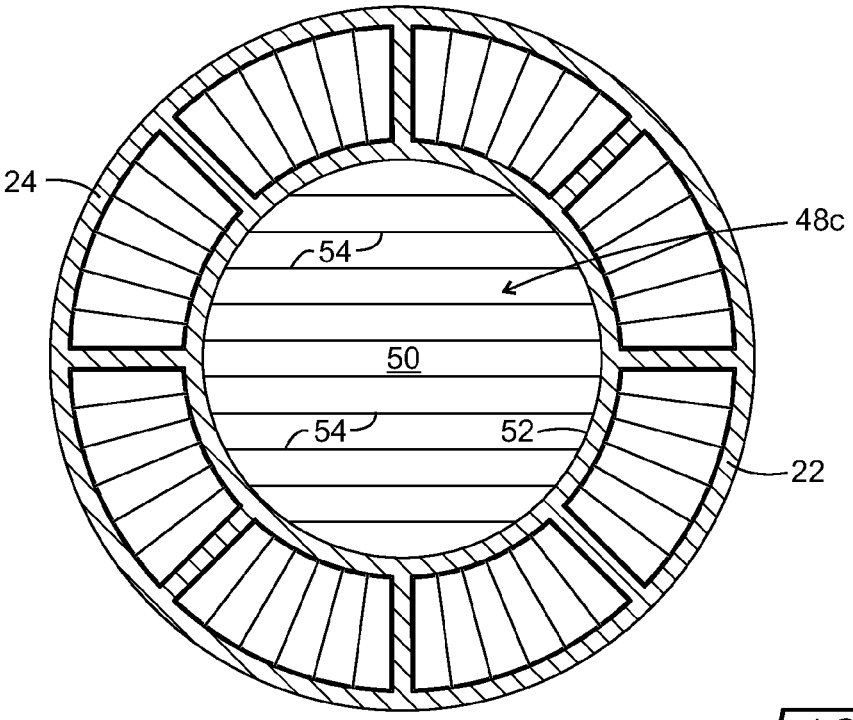
FIG. 4 is a cross-sectional view taken along line 4-4 of FIG. 1.
Figure 5:
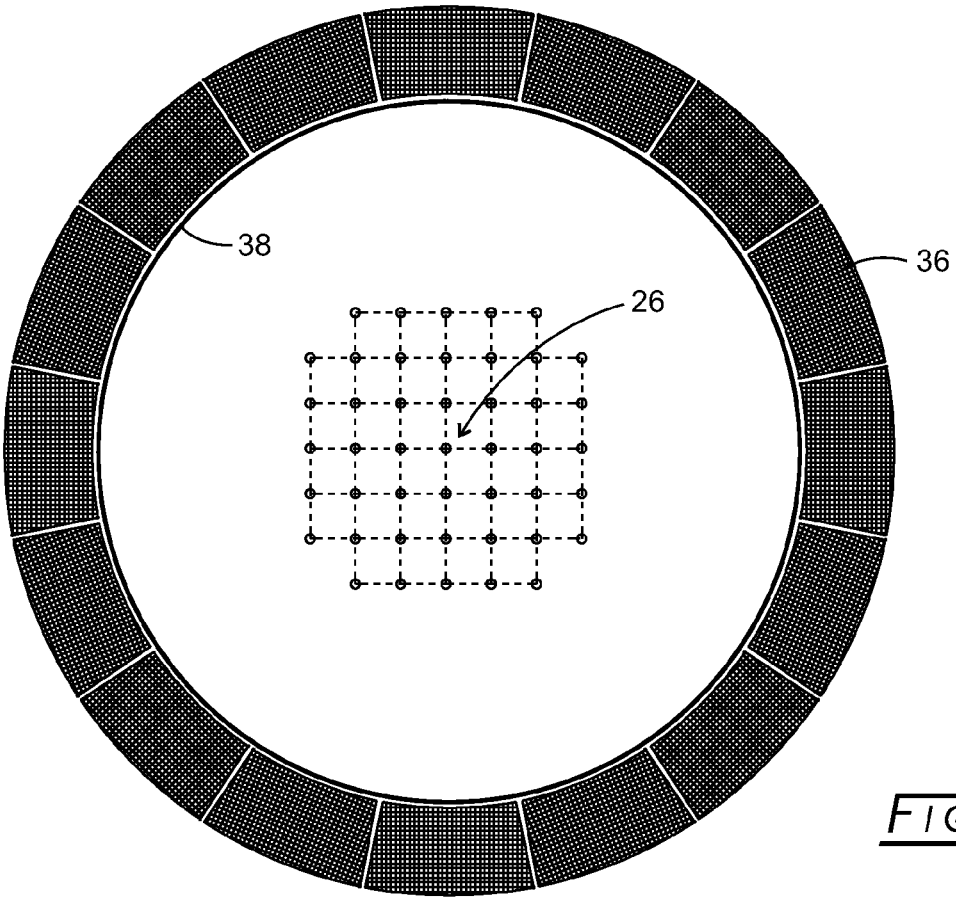
FIG. 5 is a plan view of FIG. 6.

Roof 28 and service platforms 48*a*-48*c* will each consist of a cast-in-place reinforced concrete slab 50 supported on steel deck form 52 and a series of structural steel beams 54 as schematically depicted in FIG. 4. The steel deck and the steel beams will be fabricated and assembled in the appropriate wall lift forms in the shop.

Figure 2:
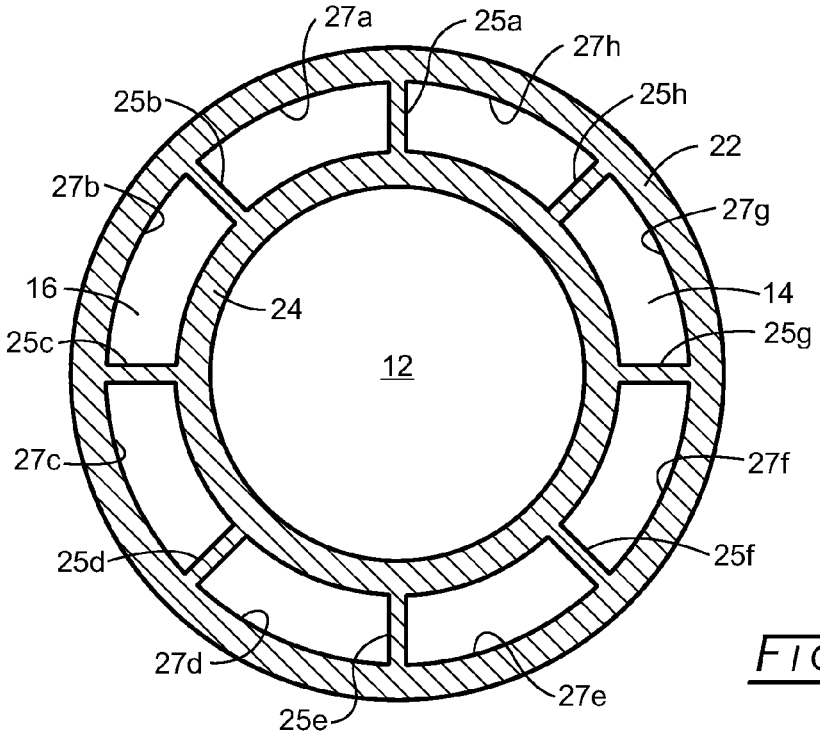
FIG. 2 is a cross-sectional view taken along line 2-2 of FIG. 1.

An important advantage of this disclosure is a vertically stiff silo structure that limits sway under wind and water loading to acceptable limits. The multiple cell arrangement with the radial shear walls, as depicted in FIGS. 1 through 3, is a key component of the disclosure in that regard.

Another important advantage of this disclosure is an optimized thickness of the silo walls. Again, the multiple cell arrangement depicted in FIGS. 1 through 3 provides the ability of load sharing between the exterior and interior annular silo walls which helps optimizing the thickness of both walls.

A further advantage of this disclosure is a silo that retains its circular shape during the construction of the 5,000 ft plus wall and considering the fact that the silo is floating in water during construction. The multiple cell arrangement of this disclosure helps maintain the circular shape of the horizontal cross section of the silo during construction.

Another advantage of this disclosure is to ensure that translation or rotation (spiral) of the vertical centerline of the silo wall remains within acceptable limits, considering the fact that the silo is floating in water during construction. The left-in-place structural steel wall forms help in maintaining the vertical and rotational (spiral) alignment of the vertical centerline of the silo.

An advantage of this disclosure is a structure that is able to resist hurricane loading during construction with minimal damage. The left-in-place structural steel wall forms play a key role in meeting this objective. It is the intent of this disclosure that within 24 or 36 hours of a hurricane warning, the structural system (concrete and structural steel) would have developed sufficient strength to safely resist anticipated loading.

While the invention has been illustrated by a specific silo height and diameter, it will be understood that such description is not imitative of the present disclosure. Also, while a pour-in-place concrete silo has been described, the disclosed silo is flexible enough in design that the contractor also could use precast concrete to construct the silo. Precast concrete may reduce the time for offshore construction of the silo, which is extremely expensive. The disclosed silo is flexible enough in design that the contractor also could use structural steel to construct the silo. Structural steel may be appropriate for mobile applications as in the case of offshore drilling operations. The skilled artisan also will appreciate that the disclosed silo could be used for mining, research, and other operations on the seabed floor.

Dynamic positioning consists of a series of propellers or thrusters (similar to boat or ship propellers) that are controlled by a computer to keep a floating structure at location using GPS or other techniques. Almost all floating offshore facilities have some degree of dynamic positioning. For the present application dynamic positioning will keep the silo at location by applying the forces necessary to resist water current, wind, etc. During operation, dynamic positioning can be used to control sway. This is unique for concrete structures since all past applications were in relatively shallow water. For 10,000-foot water, it will be likely that such a system may be needed. One embodiment would use a series of permanently mounted propellers spaced at 500 ft±. Thus, this disclosure also envisions the use of dynamic positioning to keep the floating silo at location during construction and to limit sway during operation, if required.

While the apparatus and method has been described with reference to various embodiments, those skilled in the art will understand that various changes may be made and equivalents may be substituted for elements thereof without departing from the scope and essence of the disclosure. In addition, many modifications may be made to adapt a particular situation or material to the teachings of the disclosure without departing from the essential scope thereof. Therefore, it is intended that the disclosure not be limited to the particular embodiments disclosed, but that the disclosure will include all embodiments falling within the scope of the appended claims. In this application all units are in the American unit system unless otherwise indicated, and all amounts and percentages are by weight, unless otherwise expressly indicated. Also, all citations referred herein are expressly incorporated herein by reference.

I claim:

1. Underwater concrete silo for offshore drilling and production operations, which comprises:

(a) a reinforced concrete foundation secured at or into the seabed and, if required for resistance to wind and water actions, steel piles and batter steel piles or anchors embedded into the seabed;

(b) an annular exterior vertical reinforced concrete wall supported by said foundation;

(c) an annular interior vertical reinforced concrete wall supported by said foundation and housing a central cell;

(d) a series of radial shear walls extending between said annular exterior concrete wall and said annular interior concrete wall to form a series of perimeter cells; and (e) a roof and series of horizontally extending service platforms supported off said annular outer concrete wall and said annular inner concrete wall, the underwater concrete silo embedded into the seabed an appropriate vertical distance, where the weight of the underwater concrete silo including ballast exceeds the buoyancy force on the underwater concrete silo, where the weight of the underwater concrete silo including ballast and buoyancy subjects the seabed to appropriate bearing pressures and where overturning moments and shear forces resulting from wind and water actions on the underwater concrete silo subjects the seabed to appropriate passive pressures.

2. The underwater concrete silo of claim 1, additionally comprising:

(f) a series of vertical well casings extending through said concrete foundation and down into said seabed for seating the silo into the seabed and for drilling and production operations;

(g) personnel and office space cantilevered off the exterior face of the silo.

3. The underwater concrete silo of claim 1, having a height of up to about 10,000 feet.

4. The underwater concrete silo of claim 3, having a height of up to about 5,000 feet.

5. The underwater concrete silo of claim 1, wherein there are at least 8 perimeter cells.

6. The underwater concrete silo of claim 1, wherein structural steel waterstop assemblies prevent water seepage into the silo.

7. The underwater concrete silo of claim 1, which is circular in horizontal cross section.

8. The underwater concrete silo of claim 1, wherein said roof supports one or more of cranes, hoists, and a helicopter pad.

9. The underwater concrete silo of claim 1, wherein said service platforms house oil and gas processing equipment.

10. The underwater concrete silo of claim 2, wherein said personnel and office space house one or more of offices, control rooms, and machine shops.

11. The underwater concrete silo of claim 1, which is a cast-in-place concrete structure.

12. The underwater concrete silo of claim 1, which is a precast concrete structure.

13. The underwater concrete silo of claim 1, which is a combination of cast-in-place concrete, precast concrete, and structural steel structure.

14. The underwater concrete silo of claim 1, wherein dynamic positioning assists in limiting sway during construction or operation.

15. The underwater concrete silo of claim 1, wherein thickness of said annular exterior vertical reinforced concrete wall and of said annular interior vertical reinforced concrete wall varies with height of said concrete silo.

16. The underwater concrete silo of claim 1, wherein each said annular exterior vertical reinforced concrete wall and said annular interior vertical reinforced concrete wall are formed in defined vertical height sections using stay-in-place steel liners.

17. The underwater concrete silo of claim 16, wherein said defined vertical height sections are about 8 feet.

18. The underwater concrete silo of claim 1, which is formed about the water surface.

* * * * *